United States Patent [19]

Goodson, Jr.

[11] Patent Number: 4,987,719

[45] Date of Patent: Jan. 29, 1991

[54] REINFORCED CONCRETE BUILDING CONSTRUCTION AND METHOD OF FORMING SAME

[76] Inventor: Albert A. Goodson, Jr., 13923 Myrtlea, Houston, Tex. 77079

[21] Appl. No.: 290,370

[22] Filed: Dec. 29, 1988

[51] Int. Cl.[5] ..... E04B 1/16

[52] U.S. Cl. ..... 52/743; 52/252; 52/348; 52/378; 52/741; 249/216; 249/218; 264/35; 264/135

[58] Field of Search ..... 52/250, 251, 252, 348, 52/349, 350, 238.1, 241, 378, 448, 741, 743, 745, 262, 656; 249/216, 218; 264/35, 135

[56] References Cited

U.S. PATENT DOCUMENTS

| | | | |
|---|---|---|---|
| 532,038 | 1/1895 | Doehring | 52/348 |
| 1,577,633 | 3/1926 | Collins | 52/238.1 |
| 1,735,827 | 11/1929 | Thies | 52/250 X |
| 2,298,989 | 10/1942 | Underwood | 52/378 X |
| 3,559,355 | 2/1971 | Day, Jr. . | |
| 3,659,388 | 5/1972 | Sirianni . | |
| 3,744,194 | 7/1973 | Ramberg . | |
| 4,125,981 | 11/1978 | MacLeod et al. . | |
| 4,179,858 | 12/1979 | Graham et al. . | |
| 4,253,288 | 3/1981 | Chun . | |
| 4,276,730 | 7/1981 | Lewis | 52/349 X |
| 4,489,530 | 12/1984 | Chang | 52/238.1 X |
| 4,494,353 | 1/1985 | Lewis | 52/378 X |
| 4,514,950 | 5/1985 | Goodson, Jr. . | |
| 4,551,961 | 11/1985 | Kiselewski | 52/238.1 X |

*Primary Examiner*—Richard E. Chilcot, Jr.
*Attorney, Agent, or Firm*—Dodge, Bush & Moseley

[57] ABSTRACT

A reinforced concrete building structure (10) and method of forming, including first forming a steel framing form (18) of cold formed channel shaped structural steel members of a thickness between 1/32 inch and $\frac{3}{8}$ inch including vertical framing members (19,20,21,22) and horizontal connecting members (30A–30E), then connecting a backing form (74) by connectors (76) to flanges (26) on only one side of the vertical framing members (19–22), and only adjacent the lower side of the horizontal connecting members (30A–30E) spaced at least $\frac{3}{4}$ inch from the steel framing members. Concrete is then applied pneumatically against the backing form (74) for the vertical side walls (12) with the channel shaped framing members (19–22) comprising the primary steel reinforcing and with opposed flanges (26,27) being covered outwardly by concrete at least $\frac{3}{4}$ inch in thickness. The steel framing for a roof of a relatively large span is shown in FIGS. 7–9 and separate spaced reinforced concrete layers are provided adjacent opposite sides of wide flange steel beams (50).

9 Claims, 4 Drawing Sheets

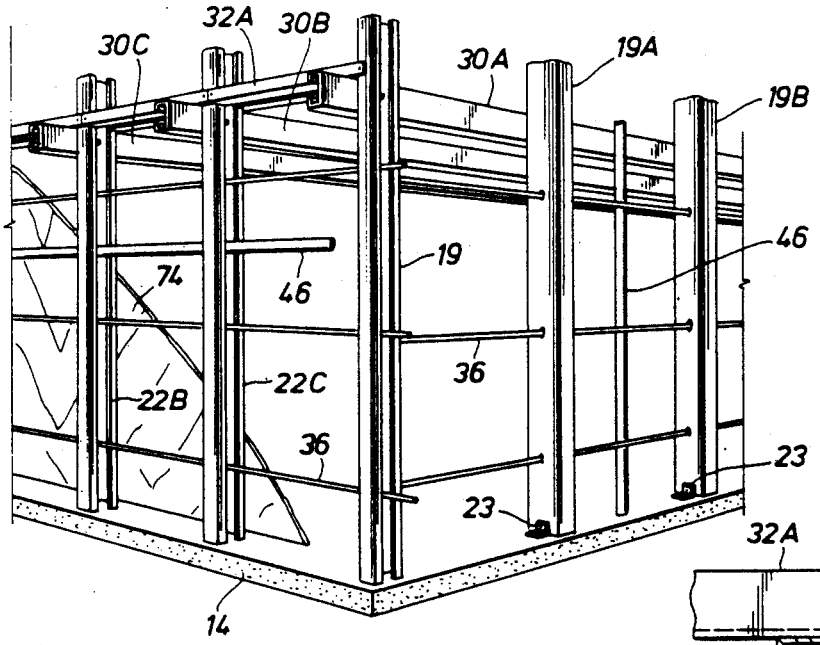
FIG. 3
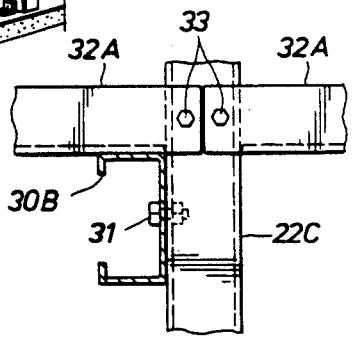
FIG. 4
FIG. 5
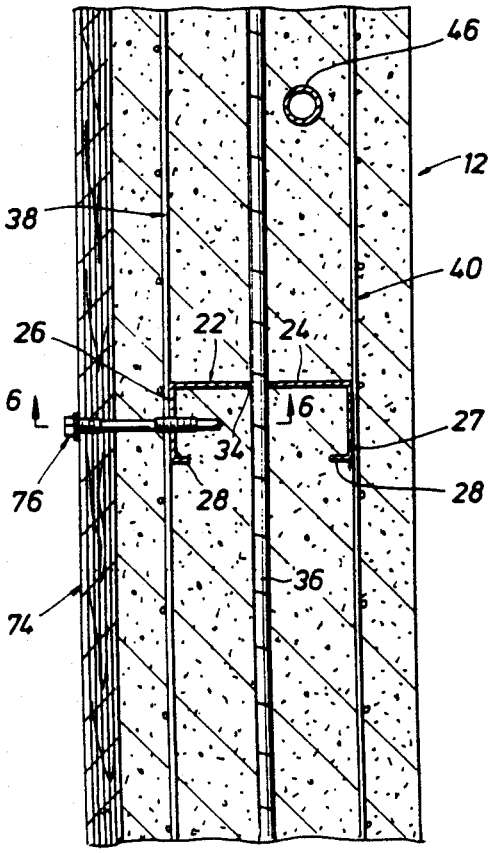
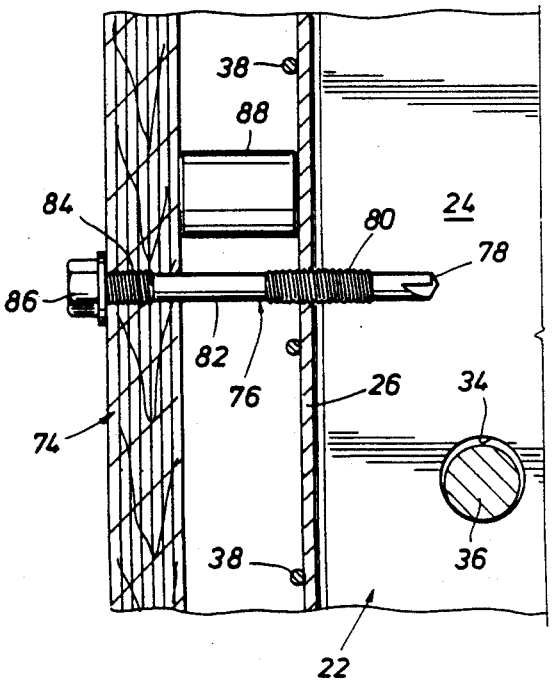
FIG. 6

REINFORCED CONCRETE BUILDING CONSTRUCTION AND METHOD OF FORMING SAME

BACKGROUND OF THE INVENTION

This invention relates to a reinforced concrete building construction and method of forming, and more particularly to such a construction and method in which concrete is applied against a single removable backing form for forming the desired panel or wall construction.

Heretofore, various types of reinforced concrete constructions have been provided for slabs, panels, walls and the like. Normally, in the construction of a vertical wall for example, relatively large diameter round reinforcing steel bars over ¼ inch in diameter have been horizontally spaced from each other and round horizontally extending reinforcing bars or wire mesh have extended between the relatively large thickness vertical reinforcing bars. Forms are placed for opposed sides of the wall, such as wooden forms braced on their outer sides, and concrete is then poured between the forms with the forms being removed after the setting of the concrete. A similar construction is used for horizontal walls forming floors, for example.

In regard to providing fireproofing of reinforced concrete structures for obtaining a desired fire rating as required under various codes or standards, it is necessary to provide a thickness of concrete of at least ¾ inch over the reinforcing steel or steel members provided for reinforcement purposes. Thus, for flanged steel members, the concrete must be at least ¾ inch in thickness outwardly of the flanges. For this reason it is necessary to space the form from the concrete at least ¾ inch from the reinforcing steel members.

Heretofore, the spacing of the wooden forms or the like for concrete is relatively complicated since such forms have to be square, plumb, and dimensionally accurate as the reinforced concrete will have the same shape. If a vertical reinforced concrete wall is being constructed, the forms are normally braced on the outer face thereof opposite the concrete. The positioning of such bracing is expensive, time consuming and cumbersome.

SUMMARY OF THE INVENTION

This invention is particularly adapted to be utilized with small thickness steel shapes, such as channel-shaped cold formed steel members of a thickness between 1/32 inch and ⅜ inch, which are used to form a rigid steel framing structure for the concrete in addition to forming reinforcing for the concrete after applied. The cold formed steel members are first formed into a steel framing structure with a backing form placed on one side only of the steel framing structure prior to the pneumatic application of concrete, and then after the pneumatic application of concrete against the single backing form the steel framing structure is used as reinforcing steel in the completed reinforced concrete structure. The term "reinforced concrete structure" as used herein is interpreted as including steel structures reinforced with concrete as well as concrete structures reinforced or fireproofed with steel. Thus, the small thickness steel members are first employed in the construction of the steel framing form using a single backing panel, and then used as reinforcing steel in the completed reinforced concrete structure.

Since this invention is particularly adapted for the construction of relatively small thickness walls or slabs having a thickness less than around eight inches, light gauge steel members are used and a small spacing such as two feet or less may be provided between the parallel steel members. Since a small spacing is required between the parallel steel members as a result of the relatively small thickness wall, an optimum economical balance between steel and concrete may be obtained. Since the light gauge steel members are rigid structural sections first used as steel framing forms for the concrete, the steel members may be easily plumbed and positioned accurately. In addition, the single backing panel or form which is later removed after setting of the concrete may be removably secured to the steel framing without any additional bracing members being required. The backing form is normally spaced from the steel framing members at least ¾ inch since a thickness of concrete over the reinforcing steel of at least ¾ inch is necessary to order to obtain the necessary fire ratings or meet fireproofing standards established by various codes or authorities, such as the American Concrete Institute.

The most commonly used cold formed steel members are between 1/16 inch and ⅛ inch in thickness and are of a channel shape or so-called C-shape which includes inturned ends of the flanges on the channel shape. As used herein, the term "channel shape" shall be interpreted as including a C-shape as well as a true "channel shape". The backing form is normally a wooden backing panel which is mounted in a spaced relation to one side of the steel frame formed by the steel members. The spacing of the backing form from the steel members is at least ¾ inch and the backing form is removably mounted in spaced relation on flanges of the metal framing form by suitable connectors, such as self-tapping, self-drilling screws positioned at intervals of around two feet along the framing members, for example. After positioning of the backing form on one side of the steel framing members, concrete is applied pneumatically against the backing form when it extends in a vertical plane. If the backing form extends in a horizontal plane, the concrete may be poured, if desired. Suitable gauging means on the other side of the framing members opposite the backing form, such as piano wire or the like, spaced from the forming frame permits the application of concrete on the opposite side of the framing members of at least ¾ inch in thickness outwardly of the metal framing members.

After the setting of the concrete, the only members which need to be removed from the completed reinforced concrete structure are the single backing form and the self drilling mounting screws.

Thus, this invention includes a method of constructing a reinforced concrete structure by first constructing a metal framing form of steel framing members having a thickness between 1/32 inch and ⅜ inch, next mounting by suitable removable connectors a removable form to one side of the steel framing form spaced from the steel framing members at least ¾ inch, then pneumatically applying concrete against the backing form when extending in a vertical plane with the concrete being of a thickness of at least ¾ inch beyond the steel framing members on the side opposite the backing form with the steel framing members acting as steel reinforcing for the concrete, and then removing the connectors from the metal framing members for removing the backing form.

An object of this invention is to provide a metal framing form for reinforced concrete which utilizes cold formed steel members of a channel shape having a thickness between 1/32 inch and ⅜ inch.

It is another object of this invention to provide a reinforced concrete structure and method in which a metal framing form for concrete utilizes small thickness metal members of a generally channel shape, and after the pneumatic application of concrete the small thickness metal members form steel reinforcing for the completed reinforced concrete structure.

A further object of this invention is to provide such a metal framing form in combination with a backing form on only one side of the metal form without any bracing being required for the backing form and with the concrete being applied pneumatically against the single backing form.

A further object of this invention is to provide such a steel framing form of flanged steel shapes in which a backing form is mounted in spaced relation on one side only of the steel framing by self drilling screws which extend through the backing form and through flanges of the framing members for mounting the backing form in spaced relation onto the steel framing members.

Another object is to provide an economical design for a reinforced concrete structure utilizing optimum amounts of steel and concrete for providing a minimum thickness wall in a minimal construction time while using a minimal amount of concrete.

Other objects, features, and advantages of this invention will become more apparent after referring to the following specification and drawings.

BRIEF DESCRIPTION OF THE DRAWINGS

FIG. 3 is a partial perspective of the rigid steel framing form of FIG. 2 erected for the reinforced concrete side walls and showing a backing form for a wall broken away;

FIG. 4 is a section taken generally along line 4—4 of FIG. 2 and showing a joint connection for the steel framing;

FIG. 5 is an enlarged sectional view of a vertical side wall of the completed reinforced concrete structure prior to the removal of the single backing form and connectors for mounting the backing form onto the thin reinforcing steel members;

FIG. 6 is an enlarged fragment of the backing form and associated self tapping, self drilling screw for securing the backing form in spaced relation to a flange of the steel framing members with a removable cylindrical magnet on the flange spacing the backing form a precise distance from the flange;

DETAILED DESCRIPTION OF THE INVENTION

Figure 1:
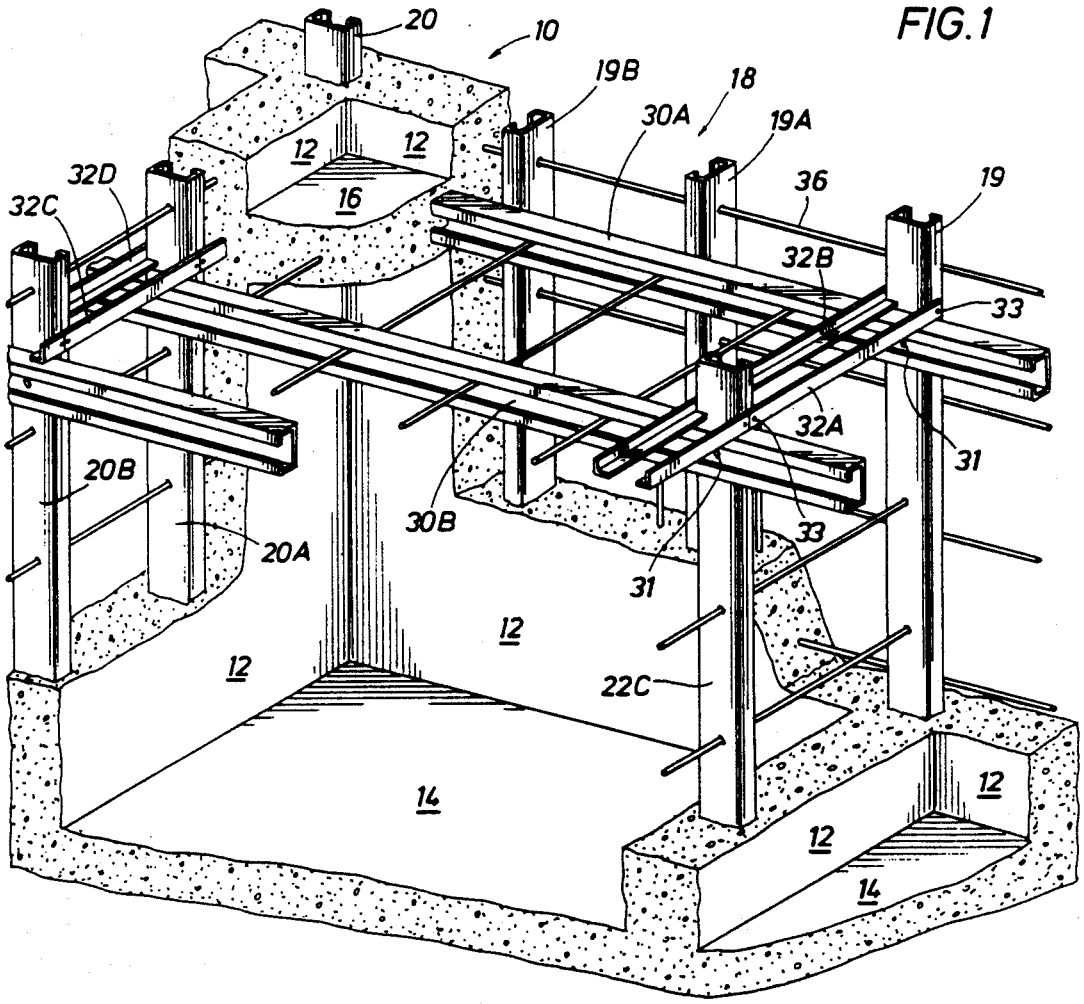
FIG. 1 is a perspective of a corner portion of a completed reinforced concrete structure constructed in accordance with the present invention with a portion of the concrete broken away from adjacent side walls to show the steel reinforcing members which provide the form for the concrete.

Referring now to the drawings for a better understanding of this invention, and more particularly to FIGS. 1-4, a portion of a completed reinforced concrete structure formed in accordance for this invention is shown at 10 in FIG. 1 with portions of the concrete broken away to illustrate the steel reinforcing. Reinforced concrete structure 10 includes a plurality of vertically extending side walls 12, a horizontal bottom wall or slab 14, and an upper generally horizontal wall indicated at 16 to form a rectangular cell which may be located within a plurality of contiguous cells. Lower wall or slab 14 is first formed as a foundation and then side walls 12 and upper wall 16 are constructed on slab 14. Such a construction as illustrated in the drawings is suitable as a cell for a maximum security prison. Multiple cells or units which form the prison may be arranged in side by side relation and in multiple stories, such as two or three stories high. It is understood that the present invention may be utilized with various types of reinforced concrete structures, including motels, various types of building constructions, and the like.

Figure 2:
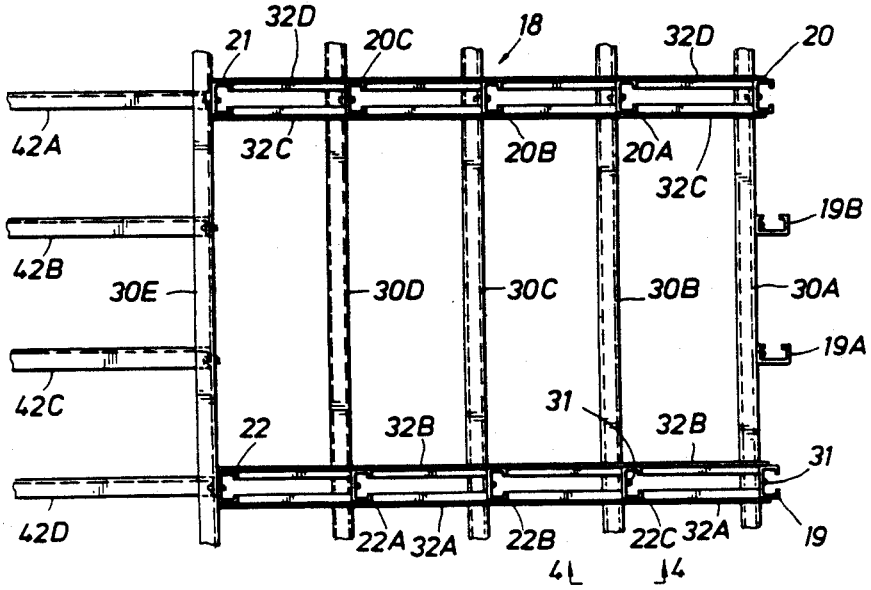
FIG. 2 is a top plan of the steel form for the structure shown in FIG. 1 and including steel framing for a horizontal top wall.

For forming the reinforced concrete structure shown in FIG. 1, a steel framing form shown generally at 18 for side walls 12 and top wall 16 is first formed on slab 14 as shown in plan view in FIG. 2 and as illustrated in FIG. 3. Frame 18 is preferably formed of cold formed steel members of a channel or C-shape. A C-shaped member is a channel-shaped member with inturned edges on the extending flanges. As used in the specification and claims herein, the term "channel shape" is interpreted as including a "C-shape" as well as a true "channel shape". Cold rolled steel is of a relatively small thickness such as 1/16 inch or ⅛ inch in thickness and may vary between 1/32 inch and ¼ inch in thickness. This invention is particular adapted for the construction of thin walled reinforced concrete structures, such as walls, panels, slabs, or the like having a thickness of between around 3 inches and 8 inches and utilized in both single and multi story structures, such as detention centers for prisoners, for example.

My prior U.S. Pat. No. 4,514,950 dated May 7, 1985, the entire disclosure of which is incorporated by this reference, is directed to a framing system utilizing a plurality of metal framing members and particularly cold rolled steel framing members of a thickness between around 1/16 inch and ⅛ inch. The present invention is directed to a reinforced concrete structure used in combination with the cold rolled steel framing members shown in my prior U.S. Pat. No. 4,514,950 with the steel framing members forming the steel reinforcing for the completed reinforced concrete structure.

Metal framing form 18 for side walls 12 and top wall 16 includes a plurality of vertically and horizontally extending framing members formed of a channel shape from cold rolled steel having a thickness between around 1/16 to ⅜ inch. Referring particularly to FIG. 2, the vertical steel framing members for two corners of form 18 are shown at 19 and 20, and additional vertical members 21 and 22 are shown to provide support for an overhanging top wall as well as the vertical side walls. Vertical members 19A and 19B are positioned between vertical members 19 and 20 while vertical members 20A, 20B, and 20C are positioned between vertical members 20 and 21. Vertical members 22A, 22B, and 22C are positioned between framing members 19 and 22. Angle clips 23 are secured to foundation 14 and the lower ends of the vertical framing members for securing such lower ends at a predetermined location. Each channel shaped vertical or horizontal member is of a similar shape. For example, as shown particularly in FIG. 5 for framing member 22, member 22 includes a web 24 with extending opposed flanges 26, 27 thereon having inturned end portions 28. Horizontally extending upper connecting members 30A, 30B, 30C, 30D and 30E formed of cold rolled channel shaped steel extend between the vertical framing members and are bolted thereto as shown particularly in FIG. 4 by suitable nut and bolt combinations 31. Horizontally extending angles 32A and 32B extend between vertical members 22, 22A, 22B, 22C, and 19 adjacent upper connecting members 30A–30E, and horizontally extending angles 32C and 32D extend between vertical members 20, 20A, 20B, 20C and 21 adjacent connecting members 30A–30E. Angles 32A–32D have one leg cutaway with the adjacent extending leg bolted at 33 to the adjacent vertical member.

Horizontally aligned openings 34 are spaced along the height of the vertical and width of the horizontal framing members and round reinforcing steel bars 36 are mounted in aligned openings 34 for reinforcement. As shown particularly in FIG. 5, a wire mesh steel material shown generally at 38 is secured to flanges 26 of the vertical framing members, such as by welding or suitable clips, and wire mesh material 40 is secured to opposed flanges 27 of the vertical framing members thereby to provide additional steel reinforcing for vertical side walls 12. While FIG. 5 is shown for vertical wall 12, it is to be understood that horizontal wall 16 would be formed in a similar manner with form 74 being on the lower side of wall 16.

As shown in FIG. 2, horizontal reinforcing members 42A, 42B, 42C and 42D of cold rolled channel shapes are received within the open side of horizontal member 30E which is a true channel shape without inturned ends such as shown at 28 in FIG. 5. Members 42A–42D extend horizontally at right angles to horizontal member 30E to form steel framing for an overhanging horizontal top wall which might be utilized as a walkway in the completed concrete structure. Conduits 46 as shown in FIG. 3 are mounted to the steel framing for being embedded in the concrete and may be utilized to receive electrical wiring or water, for example. Other suitable members may be mounted on the steel framing members, as desired, for embedment in the concrete.

Figure 7:
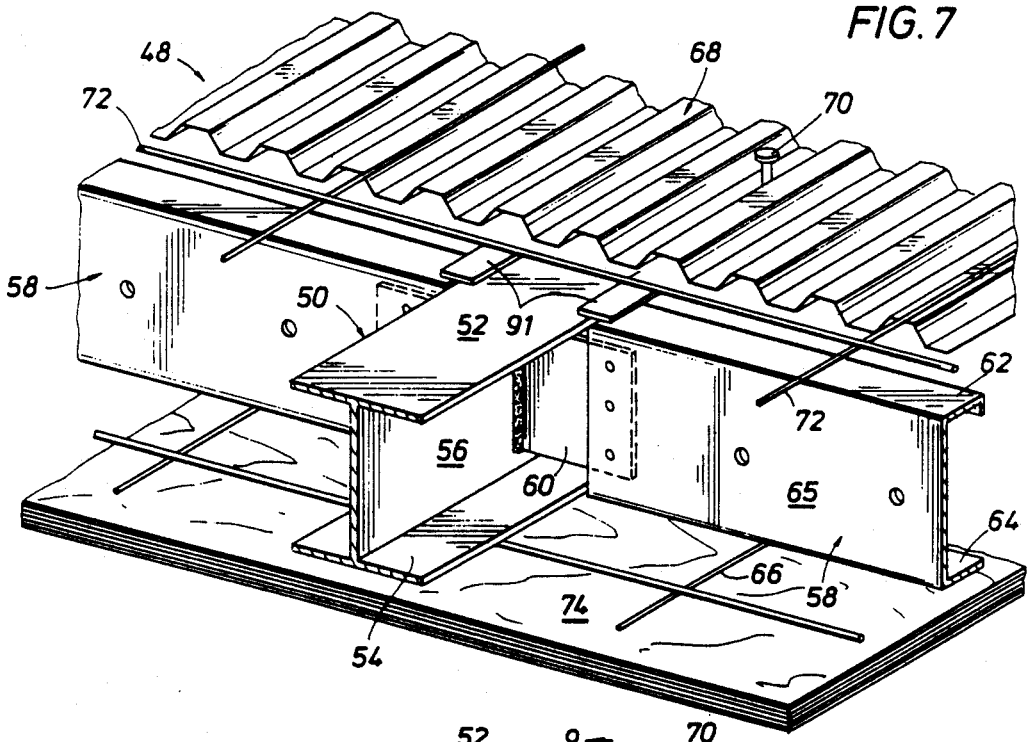
FIG. 7 is a perspective view with certain portions shown in section of the steel framing members and associated steel reinforcing mounted between a plurality of spaced parallel wide flange beams for forming a ceiling or roof of a relatively large span, and showing the framing members prior to the phased application of the concrete in two spaced layers.
Figure 8:
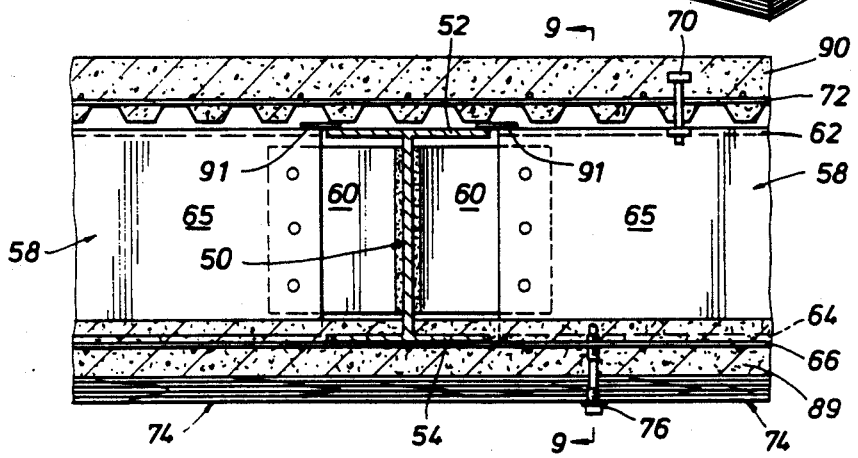
FIG. 8 is a cross sectional view of the roof shown in FIG. 7 after the application of the concrete to the steel framing form in two spaced layers and before removal of the lower backing form and associated connectors.
Figure 9:
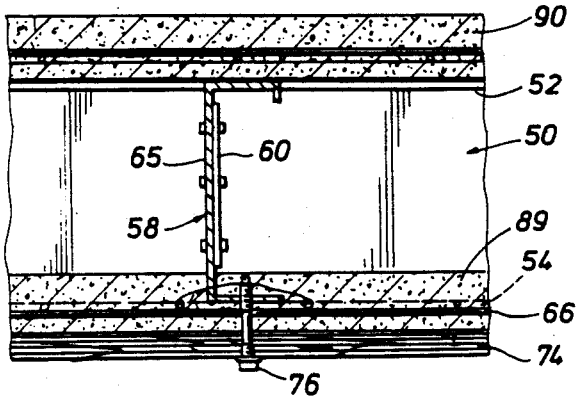
FIG. 9 is a section taken generally along line 9—9 of FIG. 8 and illustrating the thin reinforcing steel members extending between the wide flange steel beams.

After the construction of the steel framing form 18, for vertical side walls 12 and horizontal top wall 16, a backing form generally indicated as 74 and preferably formed of wood, such as plywood of around ¾ inch thickness, is positioned adjacent a side of the steel framing for vertical side walls 12 and adjacent the lower side of the steel framing for horizontal top wall 16. Referring to FIGS. 5 and 6, a suitable connector shown generally at 76 for connecting backing form 74 onto the vertical framing members is illustrated. Connector 76 comprises a self tapping, self-drilling screw including an inner end 78 for boring through thin flange 26 and having an adjacent threaded section 80 for engaging the opening in flange 26 formed by end 78. An intermediate smooth section 82 is provided between threaded portion 80 and an end threaded portion 84 adjacent head 86 of the screw. Smooth portion 82 is adapted to be in contact with the concrete and end threaded portion 84 is adapted to be threaded within backing form 74 at the outer end of head 86. Screws 76 are positioned at around two foot intervals, for example, along flange 26. As shown in FIGS. 7–9 backing form 74 is connected by connectors 76 through lower flange 64 of steel members 58 for upper wall 16 in a similar manner.

In order for the reinforced concrete construction to meet fireproofing codes or standards established by various authorities, such as the American Concrete Institute, it is necessary that concrete be at least ¾ inch in thickness from any reinforcing steel. Thus, backing form 74 is spaced at least ¾ inch from adjacent flanges 26 and wire mesh material 38. Various methods for spacing backing form 74 from flanges 26 may be utilized such as a double head nail spacer which may be driven through backing form 74 with its inner end contacting flange 26, and then easily removed after the concrete is applied and sets. A spacer which has been found to be particularly effective is a bar magnet as shown in FIG. 6 at 88 which is placed on flange 26 of channel shaped member 22 and held thereon by magnetism. Magnet 88 is of a length equal to the desired spacing, such as one inch, for example. Form 74 is then placed in face to face contact with magnets 88 which are positioned at selected intervals along several of the framing members 22. Then, connectors 76 are secured to flanges 26 to mount backing form 74 in the desired spaced relation. Bar magnets 88 may be removed after connectors 76 are mounted but before the concrete is applied and then utilized again for other backing forms 74. After backing forms 74 have been positioned on one side of framing form 10, additional spacers, such as wooden blocks or strips at the ends of the framing forms, may be mounted outwardly of front flanges 27 of the associated framing members a predetermined amount and suitable gauging means, such as piano wire, may be held taut between the spacers at a desired spacing from flanges 27 so that the proper thickness of concrete may be applied onto the outer facing walls 12. For upper wall 16 and the steel framing shown in FIGS. 7–9, concrete shown at 89 is first poured or pneumatically applied against lower backing form 74 to form the lower reinforced concrete section prior to the positioning of upper steel framing 48 including corrugated metal form 68 and wire mesh material 72. Then, the framing form for the upper concrete section is secured onto upper flanges 62 of transverse members 58 and concrete 90 is then applied onto corrugated form 68 after the setting of concrete on the lower section.

The concrete may be dispensed pneumatically either under a wet or dry delivery. A dry delivery has the water added at the nozzle for applying the concrete, such as by a Gunite system, whereas in a wet delivery the water is added to the concrete prior to being dispensed at the nozzle. The concrete is applied pneumatically under a predetermined pressure such as 50–85 psi, against the inner surface of form 74 and covers the reinforcing steel and framing members for the desired thickness. Then, the outer surface is smoothed by suitable screeding means and by troweling if needed.

In order that the concrete applied to vertical walls 12 have sufficient workability, a certain wetness to the concrete mixture is necessary. A slump test is utilized to determine the workability of fresh concrete and in order for the concrete to have desired workability without flowing an undesirable amount, it is believed that the concrete should have a slump of an optimum of one inch. However, it is believed that satisfactory results may be obtained under certain conditions with a slump between one-half inch and three inches. Of course, with a generally horizontal wall being formed such as top wall 16, concrete having a slump of more than three inches may be utilized under certain conditions. Also, the concrete may be poured for a horizontal wall. It is not necessary for vibratory means to be used to consolidate the concrete for forming the side walls 12. After the concrete has set, backing form 74 and connectors 76 may be removed. The openings formed by connectors 76 may be finished manually such as by troweling.

While upper wall 16 has been shown as being formed in the same manner as side walls 12, it is to be understood that upper wall 16 particularly if used as a roof could be formed with different framing members.

Referring to FIG. 7, the steel framing for the upper wall or roof is shown generally at 48. Since a relatively thick or deep top wall 16 is provided, it has been found economical to provide spaced upper and lower concrete reinforced sections. As well known, concrete is utilized primarily for the compressive loading while reinforcing steel is utilized primarily for tensile loading. The steel framing shown in FIG. 7 is arranged to obtain an optimum balancing of steel and concrete for meeting design criteria.

A plurality of generally parallel horizontal extending wide flange steel beams shown generally at 50 having an upper flange 52 and a lower flange 54 connected by web 56 are mounted on vertical columns (not shown). Extending between wide flange beams 50 are a plurality of transversely extending channel shaped members shown at 58 which are cold rolled steel shapes generally identical to member 22 such as shown in FIG. 5 and connected to wide flange beams 50 by clip angles 60 welded to webs 56. Channel shaped reinforcing members 58 have upper flanges 62 and lower flanges 64 extending from web 65. Wire mesh material 66 is secured to lower flanges 64 of transverse members 58.

Mounted above upper flanges 62 of reinforcing members 58 and upper flanges 52 of wide flange beams 50 is a corrugated or ribbed steel liner shown generally at 68 for supporting concrete thereon. Suitable connectors, such as nut and bolt combinations 70 provide shear connectors for concrete 90 to upper flanges 62 of the thin cold rolled transverse steel members 58. Wire mesh material 72 is mounted over corrugated form 68 and secured thereto with suitable clips. Plates 91 are welded to flange 52 of beam 50 and connected by screws to top flange 62 of steel member 58.

Figure 10:
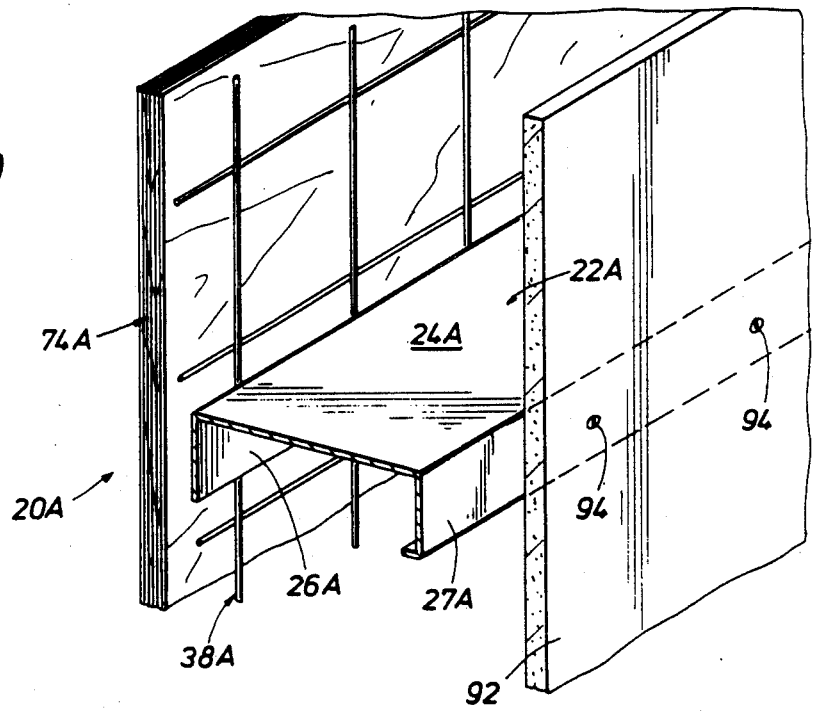
FIG. 10 is a perspective of a portion of a modified framing form for a modified reinforced concrete construction illustrating a thin reinforcing steel member having a single backing form adjacent an inner flange or side and an opposed gypsum board panel adapted to be mounted on the outer opposed side or flange after the pneumatic application of the concrete to the inner flange.
Figure 11:
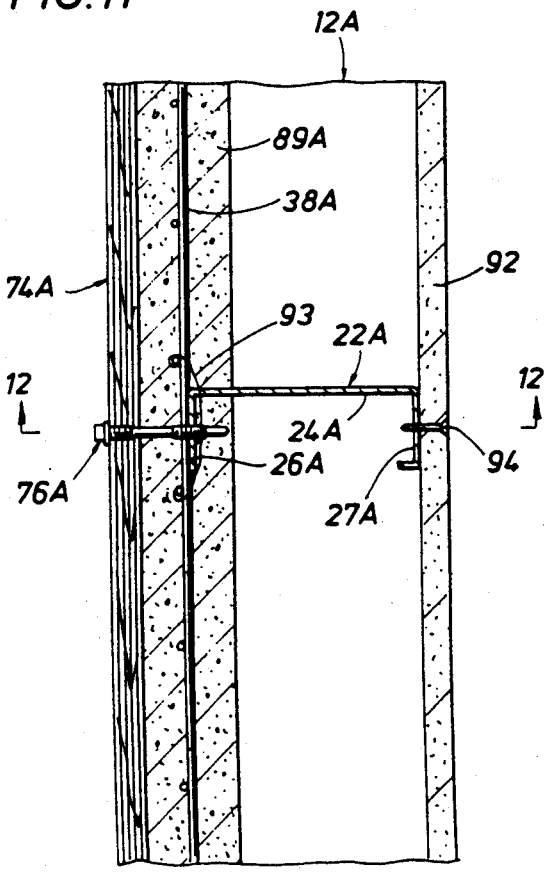
FIG. 11 is a sectional view of the modified structure shown in FIG. 10 after the application of concrete about the inner flange and prior to the removal of the backing form and associated connectors.
Figure 12:
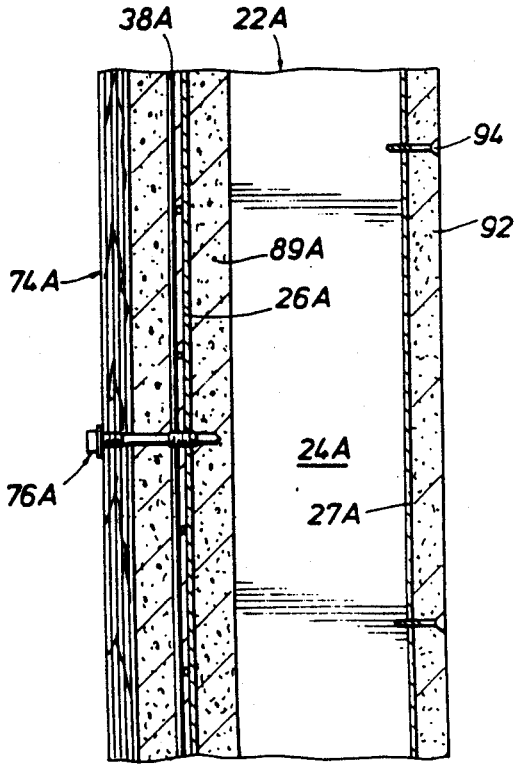
FIG. 12 is a sectional view taken generally along the line 12—12 of FIG. 11.

As another example of steel framing for a reinforced concrete wall or panel, reference is made to FIGS. 10–12 in which a separate embodiment is illustrated showing the cold rolled channel shaped members 22A which are arranged in parallel relation to each other and have flanges 26A and 27A on opposed sides of web 24A. Steel wire reinforcing 38A is secured to flanges 26A of members 22A such as by suitable wire retainers shown at 93, for example. A backing form 74A is secured in spaced relation to flanges 26A by connectors 76A and concrete 89A is applied pneumatically against backing form 74A. Upon setting of the concrete 89A, backing form 74A and connectors 76A are removed. Suitable spacers are employed to obtain the desired thickness of concrete outwardly or upwardly from flanges 26A on the side thereof opposite backing forms 74A.

Opposed flanges 27A are then enclosed or covered by gypsum board indicated at 92 connected by suitable screws 94 to upper flanges 27A. Screws 94 are preferably of a self drilling type so that they bore through flanges 27A for securing gypsum board 92. It is to be understood that other suitable materials may be mounted onto flanges 27A, such as suitable insulation, or steel decking, for example. While FIG. 10 illustrates gypsum board 92 as being secured to flange 27A, it is to be understood that concrete is first applied against backing form 74A and hardens before gypsum board 92 is mounted onto channel-shaped members 22A. Form 20A shown in FIG. 10 may be utilized for forming either a vertical wall or a horizontal wall, as desired. The combined concrete and steel structure acts as a composite structure.

Thus, a steel framing system has been provided which utilizes cold rolled channel shaped members for first forming the steel framing form for the concrete, and then forming the primary reinforcing steel for the completed reinforced concrete construction. The steel reinforcement in a reinforced concrete structure is a function of the cross sectional area, the tensile strength, and the location of the steel in the concrete. Normally reinforcing steel comprises round steel bars with a ribbed outer configuration and costly and relative complex forming is required in order to mount such reinforcing steel. Such forming usually utilizes bracing and forming on both sides of the reinforced concrete structure.

It is noted that round reinforcing bars are normally placed at a center of the thickness or depth of a concrete slab or panel since designed for tensile forces and the effective depth of the concrete in such a concrete slab is one-half the total depth since the depth of the concrete below the reinforcing bars on the tension side of the composite slab, is not utilized in the design calculations to determine the amount of reinforcing bars necessary.

In the present invention, in which the wall is reinforced by the cold rolled channel shaped members, the upper or outer portion including flanges 27 is designed for compressive loads, while the inner or lower portion including flanges 26 is designed for tensile loads. With such a design all of the concrete above flanges 26 is utilized in the design calculations for the compressive loading. Thus, an economical design with a balanced proportion of steel and concrete is provided for forming a relatively thin wall or slab from cold rolled thin channel shapes with only a small thickness of concrete extending outwardly from the opposed flanges of the channel shaped members, such as ¾ inch in thickness which is required for fireproofing. Also, the connectors may easily bore or drill through a thin flange for securing backing forms. As a result of having a backing form on one side only of reinforcing steel with the concrete applied pneumatically, vibration of the concrete is not required and hydrostatic pressure which is normally present when concrete walls are poured in place is eliminated thereby reducing the bracing or strength required for the forms. Much faster curing may also be provided since one side of the wall is exposed to air and pneumatically applied concrete is relatively dry with a slump of around one inch thereby to provide a relatively fast construction time for forming the completed reinforced concrete structure. In addition, an increased bonding is provided between the steel and the concrete as the cold rolled channel shapes have a large surface area which is in contact with the concrete and thus provide a relatively large bonding area.

While preferred embodiments of the invention have been shown and described, modifications thereof can be made by one skilled in the art without departing from the spirit of the invention.

What is claimed is:

1. A method of building a continuous non-modular reinforced concrete wall in situ comprising the steps of:

constructing a steel framing form of a plurality of spaced parallel steel framing members with said steel framing members being of a channel shape including a web with flanges extending therefrom, said steel framing members being of a thickness between 1/32 inch and ⅜ inch;

mounting transversely extending reinforcing members on said steel framing members;

positioning a backing form adjacent flanges of said steel framing members on one side of said steel framing form;

mounting a plurality of spaced connectors between said backing form and said adjacent flanges for removably securing said backing from onto said steel members and spacing said backing form at least ¾ inch from said adjacent flanges;

pneumatically applying concrete against said backing form only from the other side of said steel framing form of a thickness sufficient to cover said transversely extending reinforcing members and said adjacent flanges; and removing said backing form and said connectors from said steel members after setting of said concrete thereby to provide a panel construction about said adjacent flanges on one side of said steel framing form for forming the continuous reinforced concrete wall.

2. The method as set forth in claim 1 wherein said connectors are self drilling screws extending through said backing form and said adjacent flanges of said steel framing members.

3. The method as set forth in claim 1 including the step of mounting a separate panel construction onto the flanges of said steel members on the opposite side of said steel framing form in a spaced relation to the first mentioned panel construction.

4. The method as set forth in claim 1 including the step of mounting said steel framing members between generally parallel wide flange steel beams of a thickness greater than ⅜ inch.

5. The method as set forth in claim 1 including the step of pneumatically applying concrete against said backing form about the entire channel shape steel members and of a thickness at least ¾ inch beyond the flanges on the opposite side of said steel framing form with said steel framing members reinforcing said concrete.

6. A method of building a reinforced concrete vertical wall comprising the steps of:

constructing a vertically extending steel framing form of parallel vertical extending steel members having a thickness between 1/32 inch and ⅜ inch, said steel members being of a channel shape including a web with flanges extending therefrom and secured for maintaining a precise position;

positioning a vertically extending backing form adjacent flanges of said vertically extending steel members on one side of said steel framing;

mounting a plurality of connectors through said backing form and through said adjacent flanges for removably connecting said backing form onto said steel members and spacing said backing form at least ¾ inch from said adjacent flanges;

pneumatically applying concrete from the other side of said steel framing form against said backing form about said steel framing of a thickness sufficient to extend outwardly from the opposite side of steel framing at least ¾ inch and to enclose entirely said steel framing form for forming said concrete vertical wall with said steel framing form constituting reinforcing for said concrete vertical wall; and removing said backing form and said connectors from said steel members after setting of said concrete thereby to complete said reinforced concrete vertical wall.

7. A method of building a continuous non-modular reinforced concrete vertical wall comprising the steps of:

constructing a vertically extending steel framing form of a plurality of spaced parallel vertically extending steel framing members with said steel framing members being of a channel shape including a web with flanges extending therefrom;

positioning a wire mesh material on each side of said steel framing form and securing said wire mesh material to the adjacent flanges of the parallel steel framing members;

providing a plurality of spaced adjacent openings in the web of said parallel steel framing members;

positioning a plurality of horizontally extending reinforcing bars within said aligned openings of said steel framing members for providing reinforcing;

positioning a vertically extending backing form adjacent the flanges of said parallel steel members on one side only of said steel framing form;

securing a plurality of connectors to said backing form and the adjacent flanges of said parallel steel members for spacing said backing form at least ¾ inch from said adjacent flanges;

pneumatically applying concrete against said backing form about said steel framing form of a thickness to extend outwardly from the opposite side of said steel framing form at least ¾ inch and to enclose entirely said steel framing form for forming said concrete vertical wall with said steel framing form constituting reinforcing for said concrete; and removing said backing form and connectors from said steel members after setting of said concrete.

8. The method as set forth in claim 7 wherein said spaced parallel steel framing members are formed of a cold formed steel having a thickness between 1/32 inch and ⅜ inch.

9. A method of building a continuous non-modular reinforced concrete vertical wall in situ comprising the steps of:

constructing a vertically extending steel framing form of a plurality of spaced parallel vertically extending steel framing members with said steel framing members including a web with flanges extending therefrom;

securing horizontally extending reinforcing members between said vertically extending steel framing members;

positioning a vertically extending backing form adjacent flanges of said steel framing members on one side of said steel framing form in a predetermined spaced relation to said adjacent flanges;

removably mounting said backing form onto said adjacent flanges at a redetermined distance from said adjacent flanges;

pneumatically applying concrete from the other side of said steel framing form against said backing form of a thickness sufficient to enclose completely said vertically extending framing members and said horizontally extending reinforcing members to form the reinforced concrete wall of a predetermined thickness with said framing form providing a major portion of the steel reinforcing; and removing said backing form from said steel members after setting of said concrete to provide the continuous reinforced concrete vertical wall.

* * * * *